US008800773B2

(12) United States Patent
Inugai et al.

(10) Patent No.: US 8,800,773 B2
(45) Date of Patent: Aug. 12, 2014

(54) CARTRIDGE PACKAGING MATERIAL AND CARTRIDGE PACKAGING STRUCTURE

(75) Inventors: Yasuo Inugai, Ibaraki (JP); Hiroyuki Sugifune, Ibaraki (JP)

(73) Assignee: Hitachi Maxell, Ltd., Ibaraki-Shi, Osaka (JP)

( * ) Notice: Subject to any disclaimer, the term of this patent is extended or adjusted under 35 U.S.C. 154(b) by 59 days.

(21) Appl. No.: 13/028,493

(22) Filed: Feb. 16, 2011

(65) Prior Publication Data

US 2011/0226644 A1 Sep. 22, 2011

(30) Foreign Application Priority Data

Mar. 18, 2010 (JP) ..... 2010-062498

(51) Int. Cl.
*B65D 81/02* (2006.01)

(52) U.S. Cl.
USPC ..... 206/590; 206/307

(58) Field of Classification Search
USPC ..... 206/590, 588, 589, 591, 592, 594, 585, 206/523, 583, 521, 308.3, 307, 387.1
See application file for complete search history.

(56) References Cited

U.S. PATENT DOCUMENTS

| | | | | |
|---|---|---|---|---|
| 3,682,597 | A * | 8/1972 | Husch | 422/408 |
| 5,261,535 | A * | 11/1993 | Light et al. | 206/391 |
| 5,720,390 | A * | 2/1998 | Bostelman | 206/587 |
| 6,302,274 | B1 * | 10/2001 | Ridgeway | 206/583 |
| 6,726,017 | B2 * | 4/2004 | Maresh et al. | 206/723 |
| 7,021,024 | B2 * | 4/2006 | Kari | 53/397 |
| 2007/0045310 | A1 | 3/2007 | Yoshino et al. | |
| 2007/0175778 | A1 | 8/2007 | Imai | |
| 2007/0175780 | A1 * | 8/2007 | Yukawa | 206/308.3 |

FOREIGN PATENT DOCUMENTS

| | | | |
|---|---|---|---|
| JP | 9-40025 | A | 2/1997 |
| JP | 9-165028 | A | 6/1997 |
| JP | 2007-62742 | A | 3/2007 |
| JP | 2007-197081 | A | 8/2007 |
| JP | 2009-286425 | A | 12/2009 |

OTHER PUBLICATIONS

Office Action for Japanese Application No. 2010-062498, dated Apr. 24, 2012, including English translation.
Japanese Office Action for Application No. 2010-062498 dated Dec. 27, 2011 (with English translation).

* cited by examiner

*Primary Examiner* — Jacob K Ackun
*Assistant Examiner* — Jenine Pagan
(74) *Attorney, Agent, or Firm* — Birch, Stewart, Kolasch & Birch, LLP

(57) ABSTRACT

To improve a buffer effect on cartridges as well as to make it possible to suppress deformation or breakage of the cartridges in the case where, after a storage case containing the data recording cartridges has been put in an outer case for packaging, the outer case is dropped. A sheet-shaped member is folded so as to cover an upper surface, a lower surface, and one side surface of a storage case 40 to form a backing plate member 30. The backing plate member 30 is formed with first cutout portions 35*a* for receiving first projecting portions 48*a* of an upper surface of the storage case 40, and second cutout portions 35*b* for receiving second projecting portions 48*b* of a lower surface the storage case 40.

13 Claims, 12 Drawing Sheets

Fig. 6

| | | | Example | Comparative Example 1 | Comparative Example 2 |
|---|---|---|---|---|---|
| specification | outer case | material | reinforced S/F | WF | reinforced S/F |
| | | flap with cutout | - | present | - |
| | backing plate member | shape/number | staple shape | - | upper and lower two |
| | | presence or absence of hole | present | - | present |
| workability | | | ○ | × (flap is hardly folded) | △ |
| drop test (1) | cartridge | displacement of leader pin | ◎ | ◎ | ◎ |
| | | breakage of cartridge | ◎ | ◎ | ◎ |
| | storage case | linear breakage | ◎ | ◎ | ◎ |
| | | breakage of bridge portion | ○ | △ | ○ |
| | | breakage of top surface | × | × | × |
| | | crush of corner portion | △ | ○ | △ |
| drop test (2) | cartridge | displacement of leader pin | ◎ | ◎ | ◎ |
| | | breakage of cartridge | ◎ | ◎ | ◎ |
| | storage case | linear breakage | ◎ | ◎ | ◎ |
| | | breakage of bridge portion | ○ | ○ | ○ |
| | | breakage of top surface | ◎ | × | ◎ |
| | | crush of corner portion | ◎ | ○ | ○ |

◎ no problem
○ small damage (fragment is not separated)
△ intermediate damage (crack length of less than 50 mm)
× great damage (crack length of 50 mm or more)

CARTRIDGE PACKAGING MATERIAL AND CARTRIDGE PACKAGING STRUCTURE

BACKGROUND OF THE INVENTION

The present invention relates to a packaging material of the type in which a storage case storing data recording cartridges are stored is put in an outer case for protection, and a packaging structure for packaging the storage case using this packaging material.

Traditionally, cartridges for recording media such as disc cartridges and tape cartridges (also simply referred to as cartridges) may be replaced collectively in large numbers for backup of a host computer and the like. In such a case, a packaging type in which cartridges are each separately stored in cases is troublesome in handling. Therefore, considering working efficiency, for example, a bulk specification packaging type in which a plurality of, for example, about twenty cartridges, are collectively stored in one plastic storage case is preferred.

However, with the bulk specification packaging type, the plastic storage cases are directly inserted in an outer case (a corrugated cardboard case). Since the outer case contains a large number of cartridges and relatively has a large mass, when the outer case containing the storage case is erroneously dropped due to handling during shipping and the like, the storage case may be damaged. In particular, when an outer case 20 is dropped so that its ridge portion falls off to a floor F first as shown in FIG. 9, a large load is applied to a corner portion of a bottom surface of the storage case. Therefore, as shown in FIG. 10, a ridge portion of a storage case 40 is continuously damaged in a straight line, so that a cartridge may be deformed. It is the lower-side ridge portion that is damaged. However, for the sake of convenience, FIG. 10 shows the storage case 40 with its upper and lower sides flipped in order to clearly show a damaged state of the storage case 40.

Further, in particular, in the case where the recording media are tapes, and the tapes are arranged so that their slots (access slots) face the direction of the dropped ridge portion, since a tape slot is structurally low in strength, a cartridge is easily damaged. The reason therefor is considered as follows: The storage case moves greatly inside the outer case at the time of the dropping, and a corner portion of the storage case is subjected to a strong impact from the floor. If the slot of the tape is damaged, the position of a leader pin that is a tape leading member provided therein is displaced, and there is fear that a chucking error may occur when the cartridge is inserted into a drive.

In response to this, Patent Document 1 discloses a packaging structure for restricting movement of a storage case 40 inside an outer case 20.

The packaging type of Patent Document 1 is shown in FIGS. 11 and 12. As shown in the figures, Patent Document 1 discloses the configuration in which when the storage case 40 is put in the outer case 20, the storage case 40 is positioned to the outer case 20. Specifically, openings are formed in flaps 23 of the outer case 20 corresponding to projecting portions 48*a* formed on an upper surface 47*a* of the storage case 40. The storage case 40 is put in the outer case 20 and the flaps 23 are closed, whereby the openings 25 of the flaps are engaged with the projecting portions 48*a*.

The storage case 40 consists of an upper case 41 and a lower case 42 that are joined at flanges respectively projecting outward from their sides. The projecting portions 48*a* are also formed on a lower surface of the lower case 42 in addition to those formed on the upper surface of the upper case 41. They are formed of fitting ribs, each having a rectangular-shaped annular shape, so that, when a plurality of the storage cases 40 are stacked, they are fitted to each other.

Patent Document 1: JP2009-286425 A

If the packaging type of Patent Document 1 is adopted, the storage case 40 hardly moves inside the outer case 20, however, it is difficult to obtain a sufficient buffer effect. The reason therefor is as follows: As shown in FIG. 12, the flaps 23 are slanted when the outer case 20 is closed due to the structure of the flaps 23 of the outer case 20. Therefore, an opening 25 and a projecting portion 48*a* are relatively deeply engaged with each other in the vicinity of an end of a folded flap 23, however, an engaged state between the opening 25 and the projecting portion 48*a* becomes shallow in the vicinity of a basal portion of the flap 23.

The present invention was made in view of the problem described above. An object thereof is to improve the buffer effect on cartridges as well as to make it possible to suppress deformation or breakage of the cartridges in the case where, after a storage case containing data recording cartridges has been put in an outer case for packaging, the outer case is dropped.

SUMMARY OF THE INVENTION

A first invention relates to a cartridge packaging material for packaging a storage case that stores data recording cartridges and has first projecting portions, each projecting from an upper surface thereof, and second projecting portions, each projecting from a lower surface thereof.

The cartridge packaging material comprises: a backing plate member formed by bending a sheet-shaped member so that it covers the upper surface, the lower surface and at least one side surface of the storage case, the backing plate member having first cutout portions, each for receiving the first projecting portion, and second cutout portions, each for receiving the second projecting portion; and an outer case for storing the storage case in a fitted state in which the backing plate member is along the first surface, the second surface and the at least one side surface of the storage case.

In the first invention, instead of being directly stored in the outer case, the storage case is stored in the outer case in a state in which the backing plate member is disposed so as to be along the upper surface the lower surface, and at least the one surface thereof. At this time, the first projecting portions of the storage case are fitted into the first cutout portions, and the second projecting portions are fitted into the second cutout portions. Since the backing plate member is not inclined with respect to the upper and lower surfaces of the storage case and the upper and lower surfaces of the outer case, it is possible to prevent each projecting portion of the storage case from being shallowly engaged with each cutout portion of the backing plate member. Consequently, even if the outer case is dropped, the storage case is hardly moved inside the outer case, so that the buffer effect can be enhanced. Further, if the outer case is dropped so that it falls on the backing plate member side, the backing plate member serves as a buffer material, and an impact can be absorbed.

In a second invention according to the first invention, the backing plate member is formed of a sheet-shaped member consisting of three surfaces, which are a first surface which is along the upper surface of the storage case, and formed with the first cutout portions, a second surface which is along a bottom surface of the storage case, and formed with the second cutout portions, and a third surface foldably connecting with both the first surface and the second surface, and is along the at least one side surface of the storage case.

In the second invention, the three surfaces of the storage case are protected by the backing plate member. Therefore, if cartridges are disposed so that portions especially desired to be protected (for example, tape slots) face the third surface of the backing plate member, a protection effect can be enhanced.

In a third invention according to the first or second invention, the cutout portion is a hole formed in the backing plate member.

In the third invention, the hole that is the cutout portion of the backing plate member and the projecting portion of the storage case are engaged with each other, whereby the moving amount of the storage case inside the outer case is restricted.

In a fourth invention according to any one of the first to third inventions, the sheet-shaped member forming the backing plate member is corrugated cardboard.

In the fourth invention, the backing plate member can be easily formed.

In a fifth invention according to the fourth invention, a folding portion provided to fold the backing plate member into a plurality of surfaces is formed along a line extending in a direction perpendicular to corrugated ridge lines forming a core of the corrugated cardboard.

If the ridge lines of the core of the backing plate member are arranged to be parallel to the folding portion, the backing plate member is not necessarily folded at the folding portion, and there is fear that the backing plate member may be folded at a portion other than the folding portion (at a ridge line of the core in the vicinity of the folding portion). However, in the fifth invention, since the ridge lines of the core are arranged so as to be perpendicular to the folding portion, the backing plate member is securely folded at the folding portion.

A sixth invention relates to a cartridge packaging structure comprising: a storage case that stores data recording cartridges and has first projecting portions, each projecting from an upper surface thereof, and second projecting portions, each projecting from a lower surface thereof; and a packaging material for storing the storage case.

The cartridge packaging material is provided with the backing plate member according to any one of the first to fifth inventions and an outer case, and, when a plurality of the storage cases are stacked, the first projecting portion and the second projecting portion are engaged with each other.

In the sixth invention, a plurality of the storage cases that can be stacked one by one by engaging the first projecting portion and the second projecting portion can be stored using the backing plate member and the outer case. At this time, since the projecting portion of the storage case and the cutout portion of the backing plate member are engaged with each other, a buffer effect when the outer case is dropped can be enhanced in the same manner as in the first to fifth inventions.

In a seventh invention according to the sixth invention, a storage chamber for storing a plurality of cartridges is formed as a compartment in the storage case by a combination of an upper case and a lower case thereof that are divided up and down, the first projecting portions in even number are formed on the upper case, and include the same numbers of annular first fitting ribs and annular second fitting ribs that are larger than the annular first fitting ribs, each annular first fitting rib and each annular second fitting rib projecting from the upper surface of the upper case, the second projecting portions having the same number as the first projecting portions are formed on the lower case, and include the same numbers of annular first fitting ribs and annular second fitting ribs that are larger than the annular first fitting ribs, each annular first fitting rib and each annular second fitting rib projecting from the lower surface of the lower case, the first fitting rib of the first projecting portion and the first fitting rib of the second projecting portion have the same shape, the second fitting rib of the first projecting portion and the second fitting rib of the second projecting portion have the same shape, and the first fitting rib of the first projecting portion and the second fitting rib of the second projecting portion are engaged with each other, and the second fitting rib of the first projecting portion and the first fitting rib of the second projecting portion are fitted to each other.

In the seventh invention, the backing plate member is formed with the cutout portions into which the first fitting ribs and the second fitting ribs that form the first projecting portions are respectively fitted, and the cutout portions into which the second fitting ribs and the first fitting ribs that form the second projecting portions are respectively fitted. A buffer effect can be enhanced by this backing plate member. Further, when stacking a plurality of the storage cases, the first fitting rib and the second fitting rib that form the first projecting portions and the second fitting rib and the first fitting rib that form the second projecting portions are engaged with each other.

In an eighth invention according to the sixth or seventh invention, the first fitting ribs and the second fitting ribs are disposed point-symmetrically with respect to the center of the upper surface and the center of the lower surface respectively.

In the eighth invention, since the first fitting ribs and the second fitting ribs are disposed point-symmetrically with respect to the center of the upper surface and the center of the lower surface, when a packaging work of a plurality of the storage cases is continuously carried out, in a state in which the direction of the cartridges faces the backing plate member, the first fitting rib and the second fitting rib can be easily engaged with the backing plate member.

In a ninth invention according to the eighth invention, chamfers are formed at two corner portions located at diagonal positions of the backing plate member as front and back distinguishing portions for distinguishing the front from the back.

In the ninth invention, since the backing plate member is covered on the storage case having the first fitting ribs and the second fitting ribs that are point-symmetrically formed in a state in which the front and back of the backing plate member are distinguished, the first fitting ribs and the second fitting ribs are respectively securely engaged with the cutout portions of the backing plate member. At this time, a worker can distinguish the front and back of the backing plate member only by confirming the positions of the chamfers.

In a tenth invention according to any one of the sixth to ninth inventions, cartridges are arranged so that an access slot to a recording medium stored inside each cartridge faces the direction of the backing plate member covering the side surface of the storage case.

In the tenth invention, when the storage case covered by the backing plate member is stored in the outer case, the access slots of the cartridges are covered by the backing plate member. Therefore, an impact on the access slot with relatively low strength can be effectively reduced.

In an eleventh invention according to any one of the sixth to tenth inventions, the movable amount of the storage case inside the outer case is restricted based on the movable amount of the projecting portion of the storage case in the cutout portion of the backing plate member.

In the eleventh invention, even if the storage case is moved inside the outer case when the outer case is dropped and the like, it is configured so that the outer edge of the projecting portion of the storage case hits the inner edge of the cutout portion of the backing plate member before the storage case is contacted with the inner surface of the outer case, so that the storage case is stopped. As a result, an impact force applied to the storage case and the cartridges is reduced.

In a twelfth invention according to the eleventh invention, the storage case has flange portions, each extending outward from each side surface thereof, and a gap dimension a between an inner edge of the cutout portion of the backing plate member and an outer edge of the projecting portion of the storage case, and a gap dimension b between the flange portion and an inner surface of the packaging material are set so as to satisfy the relational expression: $0 \leq a < b$, and the moving amount of the storage case inside the outer case is smaller than the moving amount until an outer peripheral end face of the flange portion is contacted with an inner surface of the outer case.

In the twelfth invention, even if the storage case is moved inside the outer case when the outer case is dropped and the like, the projecting portion of the storage case hits the inner edge of the cutout portion of the backing plate member before the peripheral end face of the flange of the storage case is contacted with the inner surface of the outer case, so that the storage case is stopped. As a result, an impact force applied to the storage case and the cartridges is reduced.

In a thirteenth invention according to the eleventh invention, the storage case has flange portions, each extending outward from each side surface thereof, and a gap dimension a between an inner edge of the cutout portion of the backing plate member and an outer edge of the projecting portion of the storage case, and a gap dimension b between the flange portion and an inner surface of the packaging material are set so as to satisfy the relational expression: $a=b$, and the moving amount of the storage case inside the outer case is equal to the moving amount until an outer peripheral end face of the flange portion is contacted with an inner surface of the outer case.

In the thirteenth invention, even if the storage case is moved inside the outer case when the outer case is dropped and the like, the projecting portion of the storage case hits the inner edge of the cutout portion of the backing plate member at the same time when the peripheral end face of the flange of the storage case is contacted with the inner surface of the outer case, so that the storage case is stopped. As a result, an impact force applied to the storage case and the cartridges is reduced.

In a fourteenth invention according to the eleventh invention, the storage case has flexible flange portions, each extending outward from each side surface thereof, and a gap dimension a between an inner edge of the cutout portion of the backing plate member and an outer edge of the projecting portion of the storage case, and a gap dimension c between the side surface of the storage case and an inner surface of the packaging material are set so as to satisfy the relational expression:

$0 \leq a < c$, and the moving amount of the storage case inside the outer case is smaller than the moving amount until the flange is deformed, and the side surface of the storage case is contacted with an inner surface of the outer case.

In the fourteenth invention, even if the storage case is moved inside the outer case when the outer case 20 is dropped and the like, the outer edge of the projecting portion of the storage case hits the inner edge of the cutout portion of the backing plate member before the flange of the storage case is deformed, and the side surface of the storage case is contacted with the inner surface of the outer case, so that the storage case is stopped. As a result, an impact force applied to the storage case and the cartridges is reduced.

Effects Of Invention

According to the present invention, the one backing plate member separate from the outer case is folded so as to be able to cover the storage case. Since it is possible to prevent the engagement state between the first cutout portion and the first projecting portion as well as the engagement state between the second cutout portion and the second projecting portion from becoming shallow, even if the outer case containing the storage case covered by the backing plate member is dropped so that its ridge portion falls off to the floor first, it is configured so that the storage case hardly moves inside the outer case. Therefore, since an impact force applied to the corner portion of the storage case becomes weak compared with the conventional structure, breakage of the storage case is suppressed. As a result, the deformation and damage of cartridges inside the storage case can be prevented.

According to the second invention, since the protection effect on the three surfaces of the storage case can be enhanced by the backing plate member, if cartridges are disposed so that portions especially desired to be protected such as access slots of recording media face the third surface of the backing plate member, a protection effect can be enhanced. In this case, an arbitrary portion other than the access slots may be set as the portion to be protected.

According to the third invention, the cutout portion of the backing plate member is the hole, whereby the hole of the backing plate member and the projecting portion of the storage case are engaged with each other. Consequently, the moving amount of the storage case inside the outer case can be easily suppressed.

According to the fourth invention, the backing plate member can be easily formed using corrugated cardboard, and moreover, a buffer effect can be enhanced.

According to the fifth invention, since the ridge lines of the core are arranged so as to be perpendicular to the folding portions, the backing plate member can be accurately folded at the folding portions. Therefore, it is possible to prevent the occurrence of a mistake caused by the backing plate member being folded at an unintended portion during the packaging work.

According to the sixth invention, when a plurality of the storage cases are stacked, using the first projecting portions and the second projecting portions formed on the upper and lower surfaces thereof for positioning of the storage cases, each projecting portion is fitted into each cutout portion of the backing plate member, whereby a buffer effect can be enhanced. Therefore, it is not necessary to exclusively provide a projecting portion for achieving the buffer effect.

According to the seventh invention, using the backing plate member formed with the cutout portions into which the first fitting ribs and second fitting ribs that form the first projecting portions are fitted, and the cutout portions into which the second fitting ribs and the first fitting ribs that form the second projecting portions are fitted makes it possible to improve a buffer effect. Further, when a plurality of the storage cases are stacked, the first fitting rib and the second fitting rib that form the first projecting portions, and the second fitting rib and the first fitting rib that form the second projecting portions are fitted to each other, so that a positioning effect can be achieved.

According to the eighth invention, the first fitting ribs and the second fitting ribs are disposed point-symmetrically with respect to the center of the upper surface and the center of the lower surface. Thereby, when the work of continuously packaging a plurality of the storage cases is carried out, if the direction of the cartridges faces the backing plate member, the first fitting ribs and the second fitting ribs are easily engaged with the backing plate member irrespective of the direction of the storage cases. Therefore, the packaging work can be easily carried out.

According to the ninth invention, since the backing plate member is covered on the storage case having the first fitting ribs and the second fitting ribs that are point-symmetrically formed in a state in which the front and back of the backing plate member are distinguished, the first fitting ribs and the second fitting ribs are securely engaged with the cutout portions of the backing plate member. Further, since a worker can distinguish the front and back of the backing plate member only by confirming the positions of the chamfers, the packaging work can be carried out more easily.

According to the tenth invention, when the storage case covered by the backing plate member is stored in the outer case, the access slot is covered by the backing plate member, whereby an impact on the access slot with relatively low strength can be effectively reduced. Therefore, the deformation and damage of the cartridge can be effectively suppressed.

According to the eleventh to fourteenth inventions, even if the storage case is moved inside the outer case when the outer case is dropped and the like, the projecting portion of the storage case hits the inner edge of the cutout portion of the backing plate member before the storage case is contacted with the inner surface of the outer case, so that the storage case is stopped, whereby an impact force applied to the storage case and the cartridges is reduced. Therefore, the deformation and damage of the cartridges can be effectively suppressed.

BRIEF DESCRIPTION OF THE DRAWINGS

FIG. 6 is a table showing the results of drop tests related to Example, Comparative Examples 1 and 2;

DETAILED DESCRIPTION OF THE PREFERRED EMBODIMENTS

An embodiment of the present invention will hereinafter be described in detail based on the drawings.

Figure 2:
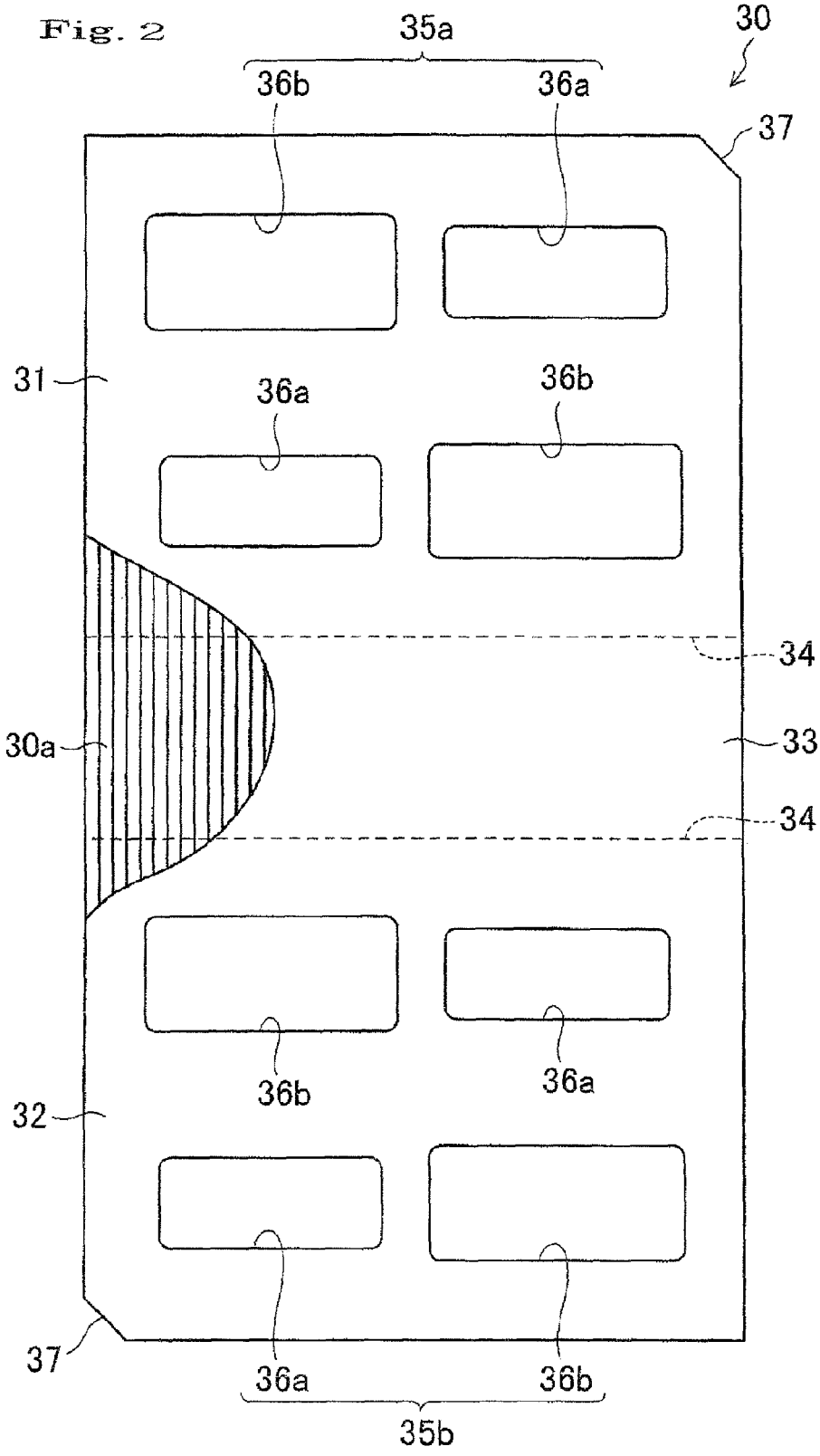
FIG. 2 is a plan view of a backing plate member used for the cartridge packaging structure of the embodiment.
Figure 3:
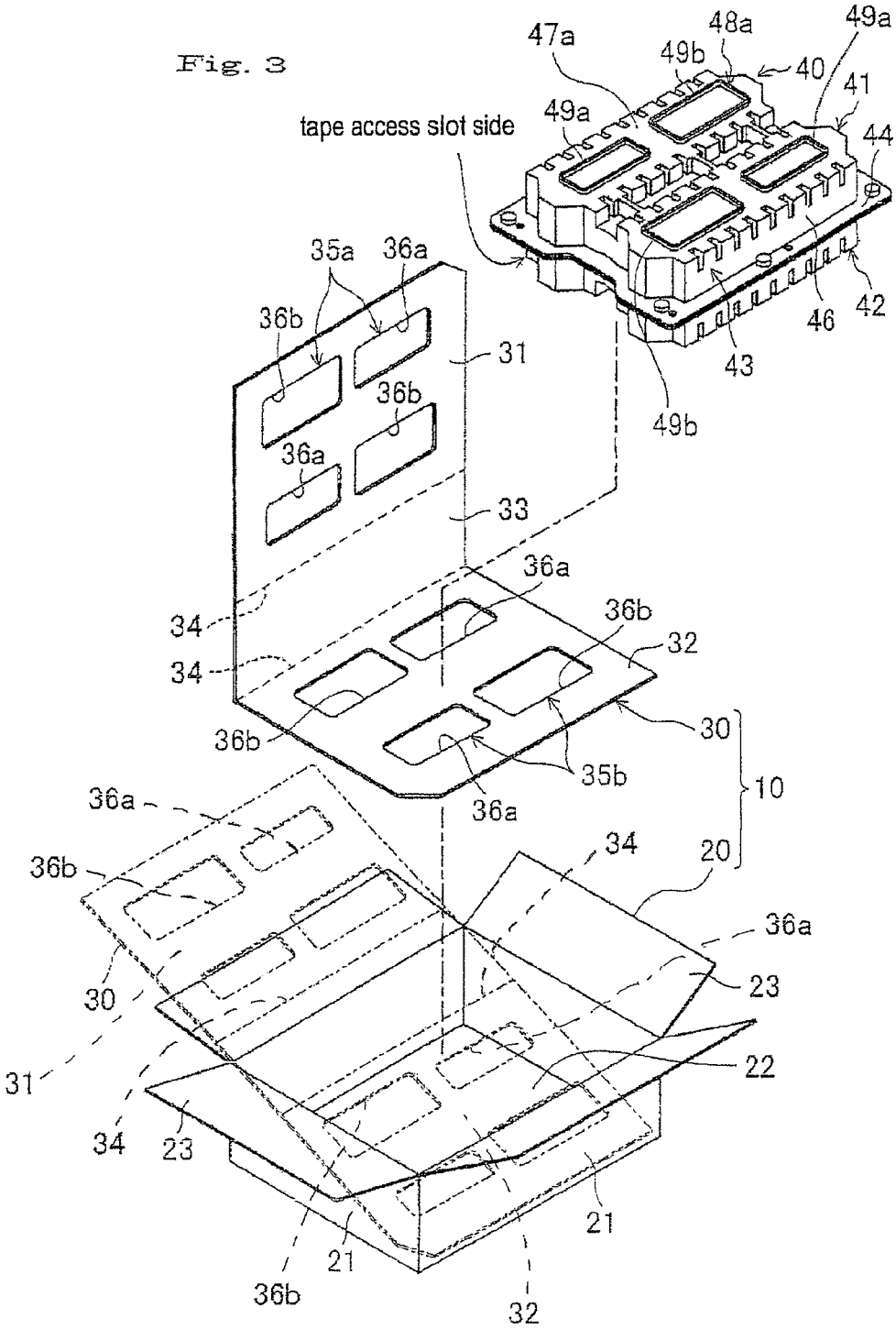
FIG. 3 is an exploded perspective view of the cartridge packaging structure of the embodiment, showing a state before being packaged.

This embodiment relates to a structure for packaging a storage case 40 that stores data recording tape cartridges (not shown) using a packaging material 10 that consists of an outer case (refer to FIG. 3) and a backing plate member 30 (refer to FIGS. 2 and 3).

<Storage Case>

Figure 1:
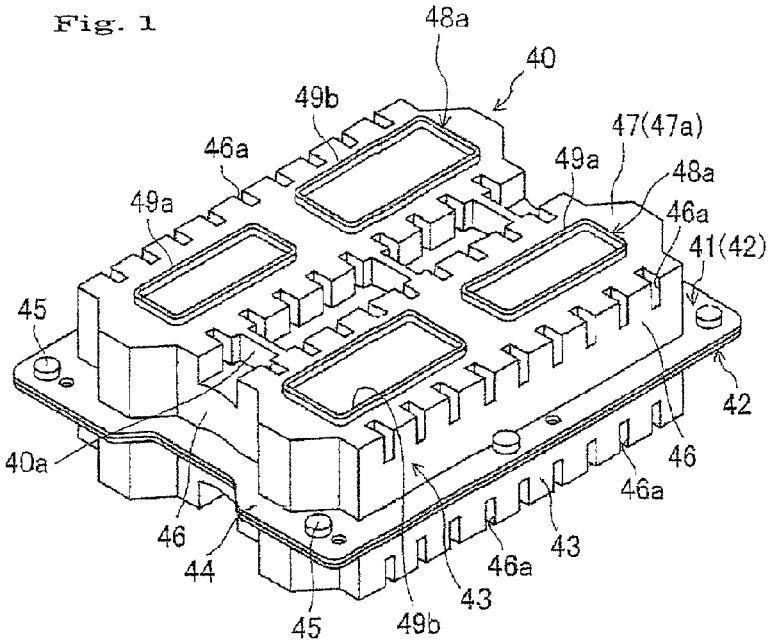
FIG. 1 is a perspective view of a storage case used for a cartridge packaging structure according to an embodiment of the present invention.

First, the storage case 40 will be described. FIG. 1 is a perspective view of the storage case 40. The storage case 40 is constructed of a combination of an upper case 41 and a lower case 42 that are divided up and down. Inside the storage case 40, a storage chamber (not shown) for storing a plurality of cartridges is formed as a compartment.

The upper case 41 and the lower case 42 are integrally formed by the so-called vacuum forming in which a synthetic resin (such as PET (polyethylene terephthalate) and PP (polypropylene)) sheet is heated to be softened, and the resultant sheet is allowed to tightly adhere to a mold with a predetermined shape, so that the sheet is formed. As the material for the upper case 41 and the lower case 42, PET having superior transparence is used. The use of the PET enables a clear visual check of the tape cartridges stored in the storage case 40 from the outside of the storage case 40. Therefore, for example, in the case where a barcode is pasted on a tape cartridge, it is possible to read the barcode through the storage case 40.

The upper case 41 and the lower case 42 substantially have the same shape, and they each have a box portion 43 open to the side to be superposed, and a flange portion 44 extending outward to the storage case 40 from an opening edge of the box portion 43 so that the two portions in a pair lay out the storage chamber. Engagement portions 45 where the flange portions 44 are allowed to tightly adhere to each other by combining concavo-convex portions so that the upper case 41 and the lower case 42 are integrated are provided at plural places of the flange portions 44.

The box portion 43 has four side surfaces 46, 46 located outside of the storage chamber and a closed surface 47 for closing one-side end portion of each side surface 46 (hereinafter, the closed surface 47 of the upper case 41 is referred to as an upper surface 47*a*, and the closed surface 47 of the lower case is referred to as a lower surface 47*b*). Although not shown in detail, the box portion 43 is formed so that 10 cartridges each are disposed in parallel in two rows. Nine groove-shaped portions 46*a*, which are formed in each corner (ridge portion), form small walls projecting from the inside, seen from the storage chamber side, these walls serve as partitions for adjacent cartridges, so that positions of the cartridges are retained in the storage chamber.

The storage case 40 is formed with first projecting portions 48*a*, each projecting outward from the upper surface 47*a* of the upper case 41 and second projecting portions 48*b*, each projecting outward from the lower surface 47*b* of the lower case 47. The second projecting portions 48*b* generally have the same shape as the first projecting portions 48*a* and are arranged with the same arrangement. If the storage case 40 is flipped upside down, the same appearance as that of the first projecting portions 48*a* is shown. Therefore, in FIG. 1, reference numerals denoting respective portions of the lower case 42 including the second projecting portions 48*b* are shown in brackets together with reference numerals denoting the respective portions of the upper case 41 for the sake of convenience.

The four first projecting portions 48*a* are formed on the upper case 41, and the upper case 41 includes two each of rectangular annular-shaped first fitting ribs 49*a* that project from the upper surface 47*a* of the upper case 41 and rectangular annular-shaped second fitting ribs 49*b* that are larger than the first fitting ribs 49*a*. The first fitting ribs 49*a* are disposed at positions of one diagonal side on the upper surface 47*a* of the upper case 41, while the second fitting ribs 49*b* are disposed at positions of the other diagonal side on the upper surface 47*a*.

Further, the four second projecting portions 48*b* are formed on the lower case 42, and the lower case 42 includes two each of rectangular annular-shaped first fitting ribs 49*a* that project from the lower surface 47*b* of the lower case 42 and rectangular annular-shaped second fitting ribs 49*b* that are larger than the first fitting ribs 49*a*. The first fitting ribs 49*a* are disposed at positions of one diagonal side on the lower surface 47*b* of the lower case 42, while the second fitting ribs 49*b* are disposed at positions of the other diagonal side on the lower surface 47*b*.

The first fitting ribs 49*a* on the upper case 41 side and the first fitting ribs 49*a* on the lower case 42 side have the same shape. Further, the second fitting ribs 49*b* on the upper case 41 side and the second fitting ribs 49*b* on the lower case 42 side have the same shape.

Each first fitting rib 49*a* and each second fitting rib 49*b* forming the first projecting portions 48*a* on the upper case 41 side and each second fitting rib 49*b* and each first fitting rib 49*a* forming the second projecting portions 48*b* on the lower case 42 side are formed to have a size in which the first fitting rib 49*a* and the second fitting rib 49*b* are fitted to each other. Specifically, the inner dimensions of a pair of opposing longer sides of the second fitting rib 49*b* are set slightly larger than the outer dimensions of a pair of opposing longer sides of the first fitting rib 49*a*, and the inner dimensions of a pair of opposing shorter sides of the second fitting rib 49*b* are set slightly larger than the outer dimensions of a pair of opposing shorter sides of the first fitting rib 49*a*. By this arrangement, if a plurality of the storage cases 40 are stacked, the first fitting rib 49*a* of the first projecting portion 48*a* and the second fitting rib 49*b* of the second projecting portion 48*b* are fitted to each other, and the second fitting rib 49*b* of the first projecting portion 48*a* and the first fitting rib 49*a* of the second projecting portion 48*b* are fitted to each other (the first projecting portion 48*a* and the second projecting portion 48*b* are engaged with each other).

Further, the first fitting ribs 49*a* and the second fitting ribs 49*b* are respectively disposed at positions that are point-symmetrical with respect to the center of the upper surface 47*a* of the upper case 41 as well as with respect to the center of the lower surface 47*b* of the lower case 42. The positional relationship between the first fitting rib 49*a* and the second fitting rib 49*b* on the upper case 41 side is the same as the positional relationship between the first fitting rib 49*a* and the second fitting rib 49*b* on the lower case 41 side.

<Backing Plate Member and Outer Case>

Next, the backing plate member 30, whose plan view is shown in FIG. 2, will be described.

This backing plate member 30 is formed of one sheet-shaped member made of corrugated cardboard. The backing plate member 30 is foldably formed so as to respectively cover the upper surface 47*a*, lower surface 47*b* and one side surface 46 of the storage case 40.

Specifically, the backing plate member 30 has three surfaces in total: a first surface 31 disposed so as to be along the upper surface 47*a* of the storage case; a second surface 32 disposed so as to be along the bottom surface of the storage case 40; and a third surface 33 foldably connecting with both the first surface 31 and the second surface 32, and disposed so as to cover the one side surface 46 of the storage case 40. Further, in the backing plate member 30, folding lines or perforation lines are formed as linear folding portions between the first surface 31 and the third surface 33 and between the second surface 32 and the third surface 33 so that the backing plate member 30 can be folded between a plurality of surfaces (three surfaces in this embodiment). The linear folding portions 34 are formed perpendicular to the longer sides of the backing plate member 30.

In FIG. 2, the backing plate member 30 partially torn to show a core 30*a* is shown. As shown in the figure, ridge lines of a corrugated pattern (mountains and valleys) of the core become parallel to the longer sides of the backing plate member 30 in FIG. 2. Therefore, the folding portions 34 are formed along lines extending perpendicular to the ridge lines of the core.

The first surface 31 is formed with first cutout portions 35*a*, each for receiving the first projecting portion 48*a* of the storage case 40. The second surface 32 is formed with second cutout portions 35*b*, each for receiving the second projecting portion 48*b* of the storage case 40. The first cutout portion 35*a* and the second cutout portion 35*b* are specifically holes (openings) formed in the first surface 31 and the second surface 32. These cutout portions are formed in a size in which, when the projecting portion 48*a*, 48*b* is fitted, there is a slight gap around the entire periphery thereof.

The first cutout portions 35*a* include first openings 36*a* and second openings 36*b*. The first openings 36*a* are formed so that their positions and shape correspond to those of the first fitting ribs 49*a* on the upper case 41 side, and the second openings 36*b* are similarly formed so that their positions and the shape correspond to those of the second fitting ribs 49*b* on the upper case 42 side. The second cutout portions 35*b* include first openings 36*a* and second openings 36*b*. The first openings 36*a* are formed so that their positions and shape correspond to those of the first fitting ribs 49*a* on the lower case 42 side, and the second openings 36*b* are similarly formed so that their positions and the shape correspond to those of the second fitting ribs 49*b* on the lower case 42 side. The first openings 36*a* of the first cutout portions 35*a* and the first openings 36*b* of the second cutout portions 35*b* have the same dimensions and shape, and the second openings 36*b* of the first cutout portions 35*a* and the second openings 36*b* of the second cutout portions 35*b* have the same dimensions and shape. In addition, each second opening 36*a* has a larger opening area than each first opening 36*b*.

Chamfers 37 are formed at an upper right corner portion and a lower left corner portion in the figure. The chamfers 37 are used as front and back distinguishing portions for distinguishing the front from the back of the backing plate member 30 when carrying out the packaging operation. Further, the chamfers are also used as a portion, at which a finger and the like are hooked when the backing plate member is taken out from the outer case after the packaging. The chamfers 37 may also be formed at an upper left corner portion and a lower right corner portion as long as they are located at diagonal positions of the backing plate member 30.

As shown in FIG. 3, the outer case 20 is a common corrugated cardboard case. The outer case 20 is configured so that its dimensions allow the storage case 40 and the backing plate member 30 to be stored in a state in which the upper surface 47*a*, lower surface 47*b* and one side surface of the storage case 40 are covered with the backing plate member 30. The outer case has four side plates 21, a bottom plate 22 and four flaps 23 for closing an upper end opening.

<Packaging Work>

At the time of the packaging, the work is carried out as shown in

Figure 4:
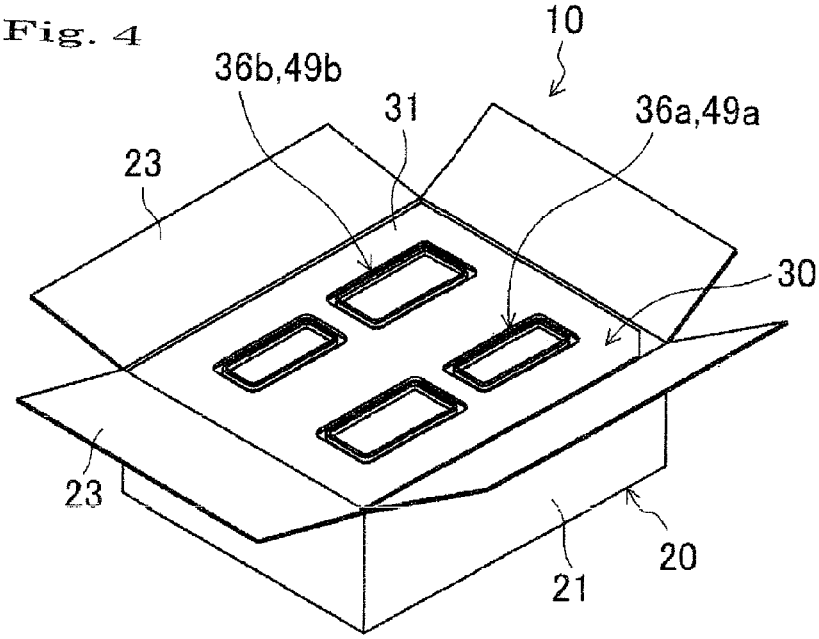
FIG. 4 is a perspective view of the cartridge packaging structure of the embodiment, showing a state during packaging.

FIGS. 3 and 4. In FIG. 3, the backing plate member 30 in a state of being folded is shown in a solid line. It shows a state in which the folded backing plate member 30 is put in the outer case 20, and the storage case 40 is put onto it. However, in the actual work, the second surface 32 portion of the backing plate member 30 is put in the outer case 20, which is straight as it is without being folded, made slanted as shown in an imaginary line, and the storage case 40 is pushed into the outer box 20 while sliding the storage case 40 on the backing plate member 30. Thereby, the workability is improved.

In the case where ridge lines of the core 30*a* of the backing plate member 30 are formed so that they become parallel to the folding portions 34, the backing plate member 30 is not necessarily folded at the folding portions 34, and it may be folded at portions other than those portions (ridge lines of the core in the vicinity of both sides of the folding portion). In the present embodiment, since the ridge lines of the core 30*a* are made to be perpendicular to the folding portions 34*a*, the backing plate member 30 can be accurately folded at the folding portions 34. Therefore, a work error of the packaging work can be prevented.

Further, the first fitting rib 49*a* and the second fitting rib 49*b* formed on the storage case 40 have different sizes as described above. Therefore, the first opening 36*a* and the second opening 36*b* formed on the backing plate member 30 so as to correspond to the first fitting rib 49*a* and the second fitting rib 49*b* also have different sizes. Therefore, unless the backing plate member 30 is put in the outer case 20 with its front and back determined, the relationship in which the first opening 36*a* and the first fitting rib 49*a* becomes a pair and the second opening 36*b* and the second fitting rib 49*b* become a pair cannot be kept, and the occurrence of the opposite relationship is considered. However, in the present embodiment, if the work is carried out so that the chamfers 37 of the backing plate member 30 are always positioned at the upper right and the lower left, the front and back of the backing member 30 won't be reversed. Therefore, if storage cases carried on the production line are put in outer cases in the fixed direction during the work process, the relationship between the first and second fitting ribs 49*a* and 49*b*, and the first and second openings 36*a* and 36*b* is kept. Therefore, a work error can be prevented.

Upon completion of the above work, the backing plate member 30 is folded generally perpendicularly between the second surface 32 and the third surface 33 in the outer case 20 as shown in the solid line in FIG. 3. Thereafter, the backing plate member 30 is further folded so as to be superposed on the upper case 41, whereby it becomes a state shown in FIG. 4. Then, the flaps of the outer case 20 are closed whereby the packaging work of one storage case 40 is completed.

The work of putting cartridges in the storage case 40 has been carried out in advance, and the cartridges in the storage case 40 are arranged so that their slots (access slots) of the tapes as recording media all face the same direction. During the packaging, the work is carried out so that the tape cartridge slots face the third surface 33 of the backing plate member 30 that covers the side surface 46 of the storage case 40. Thereby, the tape slots which are considered to require protection the most are protected by the backing plate member 30.

<Setting of Movable Amount of Storage Case in Outer Case>

In the present embodiment, when the respective fitting ribs 49*a* and 49*b* of the storage case 40 are fitted into the respective cutout portions 35*a*, 35*b* in the backing plate member 30, the dimension of a gap formed between an outer edge of each projecting portion 49*a*, 49*b* and an inner edge of each cutout portion 35*a*, 35*b* is set within a predetermined range, so that the movable amount of the storage case 40 in the outer case 20 won't become too large. That is, in the present embodiment, it is set so that the movable amount of the storage case 40 in the outer case 20 is restricted based on the movable amount of each projecting portion 49*a*, 49*b* of the storage case 40 in each cutout portion 35*a*, 35*b* of the backing plate member 30.

FIG. 5(A) is a plane arrangement view showing a state in which the storage case 40 covered by the backing plate member 30 is put inside the outer case 20, and FIG. 5(B) is a cross sectional view along line B-B of FIG. 5(A). In this figure, assume that the gap dimension between the outer edge of the projecting portion 49*a*, 49*b* and the inner edge of the cutout portion 35*a*, 35*b* is a, and a gap dimension between the third surface 33 of the backing plate and an outer peripheral edge of the flange portion 44 is b. Further, on the side not covered by the third surface 33 of the backing plate (the upper side in the figure), a gap dimension between an inner surface of the outer case 20 and a peripheral surface of the flange portion 44 is b. In other words, the gap dimension between the outer peripheral edge portion of the flange portion 44 and the packaging material 10 is represented by b.

In the above construction, in order to set the moving amount of the storage case 40 inside the outer case 20 so that an outer peripheral end face of the flange portion 44 of the storage case 40 is not contacted with an inner surface of the backing plate member 30 or the inner surface of the outer case 20 (namely, an inner surface of the packaging material), it is required that the outer edge of the projecting portion 49*a*, 49*b* be contacted with the inner edge of the cutout portion 35*a*, 35*b* before the outer peripheral end face of the flange portion 44 of the storage case 40 is contacted with the inner surface of the backing plate member 30 or the inner surface of the outer case 20. Therefore, it is necessary to satisfy the relational expression:

$$0 \leq a < b \quad (1)$$

Further, in order to restrict the moving amount of the storage case 40 inside the outer case 20 so that the outer edge of the projecting portion 49*a*, 49*b* is contacted with the inner edge of the cutout portion 35*a*, 35*b* almost at the same time when the outer peripheral end face of the flange portion 44 of the storage case 40 is contacted with the inner surface of the backing plate member 30 or the inner surface of the outer case 20, it is necessary to satisfy the relational expression:

$$a = b \quad (2).$$

Summarizing the above, in order to set the moving amount of the storage case 40 inside the outer case 20 so that the movement of the storage case 40 inside the outer case 20 is stopped until the outer peripheral end face of the flange portion 44 of the storage case 40 is contacted with the inner surface of the backing plate member 30 or the inner surface of the outer case 20, it is necessary to satisfy the relational expression:

$$a \leq b \quad (3).$$

<Drop Tests>

Next, the results of performing two types of drop tests with three types of test subjects will be described by using a table of FIG. 6.

Figure 11:
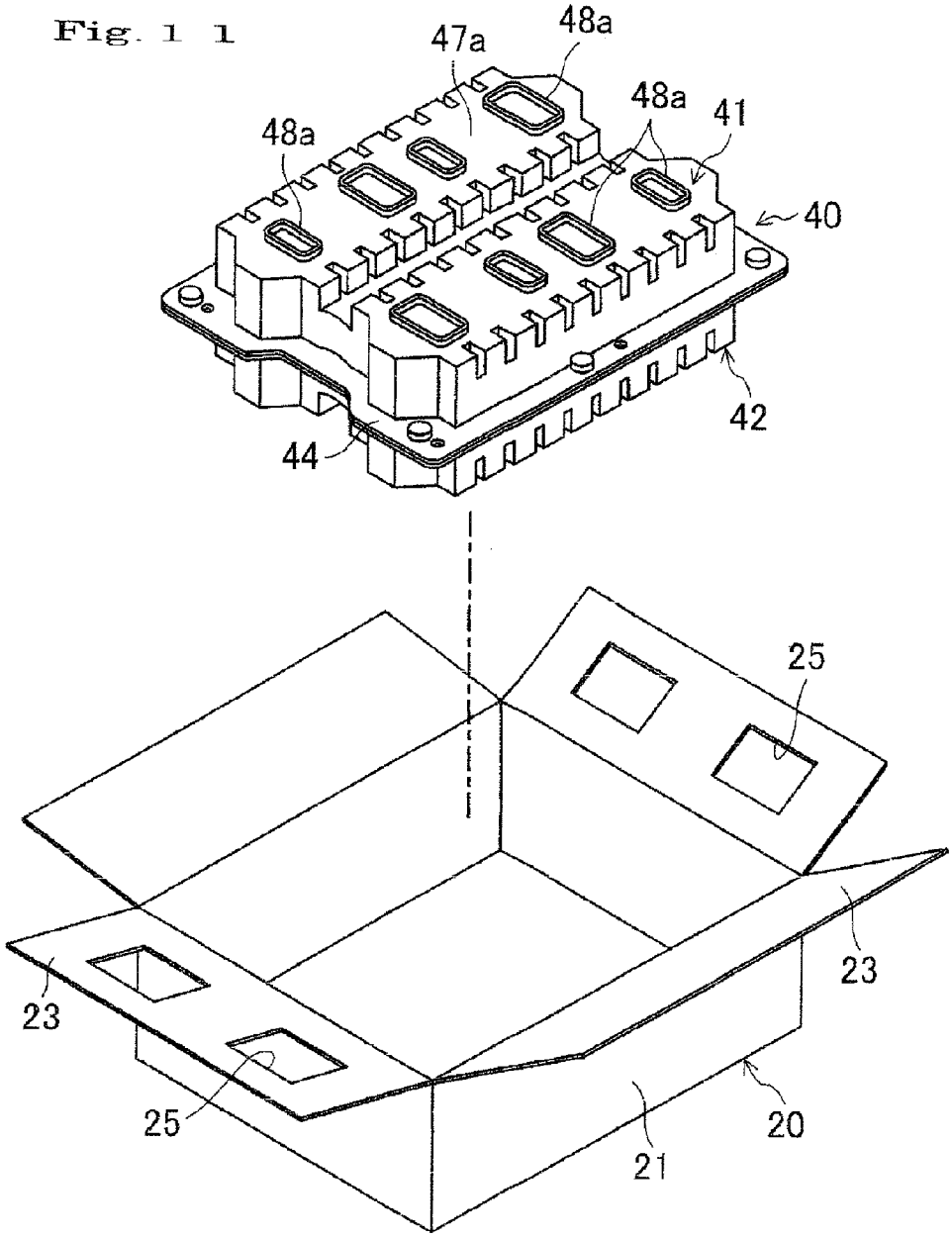
FIG. 11 is a perspective view showing the conventional (Comparative Example 1) cartridge packaging structure.
Figure 12:
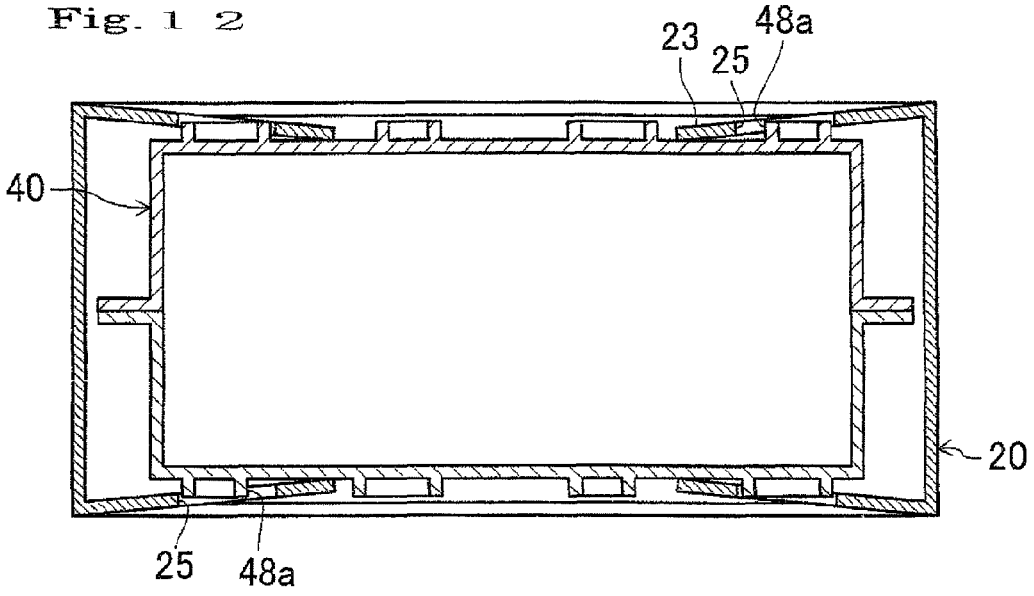
FIG. 12 is a cross sectional view showing the cartridge packaging structure of FIG. 11.
Figure 13:
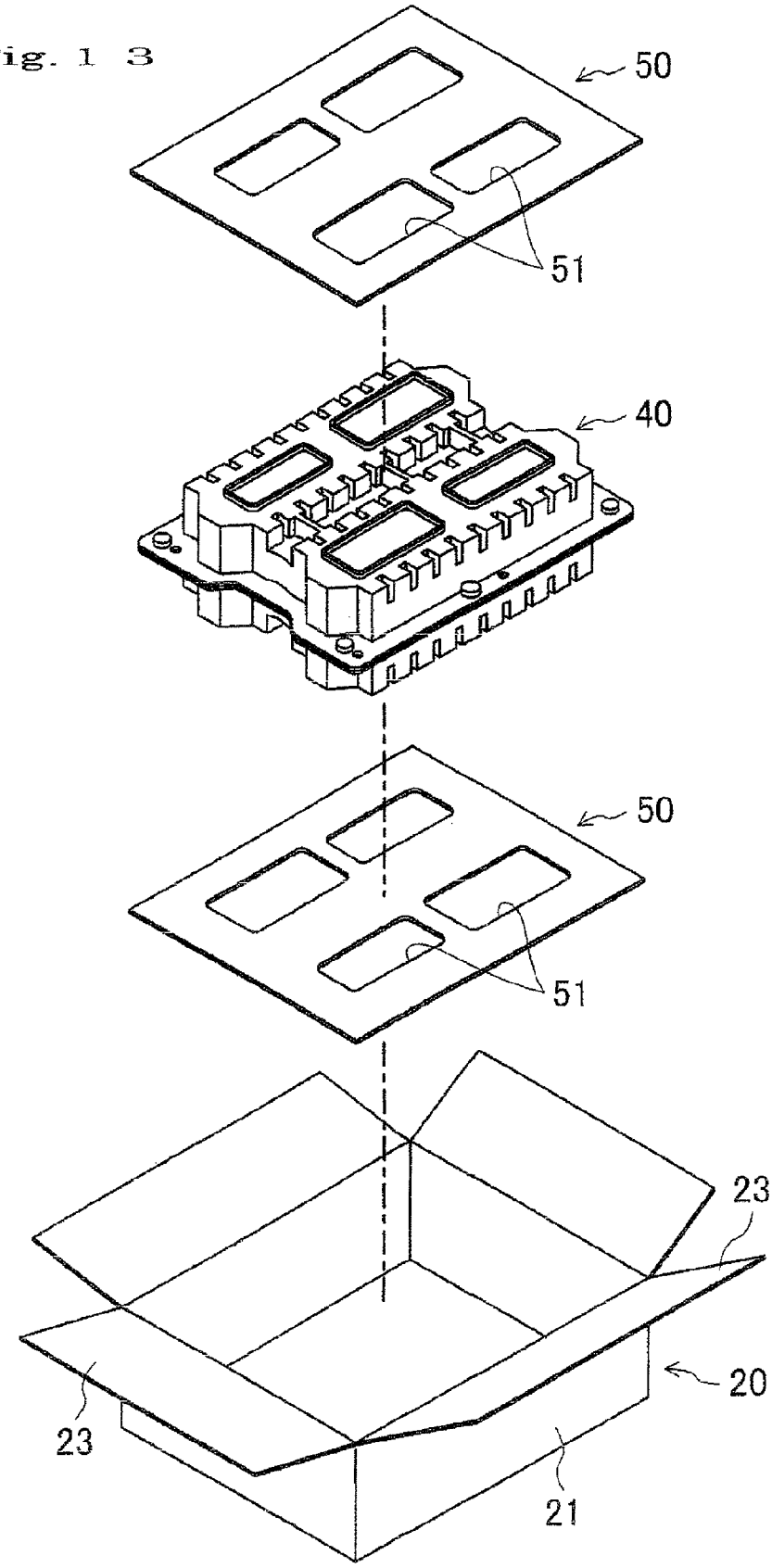
FIG. 13 is a perspective view showing the cartridge packaging structure of Comparative Example 2.

First, as the test subjects, the one in which the storage case 40 is packaged using the backing plate member 30 of the present embodiment was used as an Example. As shown in FIGS. 11 and 12, the one in which flaps 23 were provided with openings 25 so that they fitted over the projecting portions 48*a* of the storage case 40 was used as Comparative Example 1. As shown in FIG. 14, the one in which, using two backing plate members 50 with cutout portions 51 that were separately applied to the upper and lower surfaces of the storage case 40, the storage case 40 was packaged by the outer case 20 in a state in which the storage case 40 was held by the backing plate members 50 from the above and below like a sandwich shape was used as Comparative Example 2. For the outer case 20 of Example and Comparative Example 2, the one formed of single flute cardboard was used, and for the outer case 20 of Comparative Example 2, the one formed of double flute cardboard was used.

In drop test (1), the packaged case was dropped on a P-tile from a height of 1 m 10 times. As a method of dropping the case, the following method was adopted. For the first time, the case was dropped so that its corner on the side where there were the tape cartridge slots of the tape cartridge hit the floor surface. For the second to fourth time, the case was dropped so that its three ridge lines forming the corner hit the floor surface. For the fifth to tenth time, the case was dropped so that its each of six surfaces of the outer case 20 in turn hit the floor.

In drop test (2), the packaged case was dropped on the P-tile from a height of 0.75 m 6 times. As a method of dropping the case, the following method was adopted: For the first to sixth time, the case was dropped so that its each of 6 surfaces of the outer case 20 in turn hit the floor.

The test results are shown in the table of FIG. 6. In FIG. 6, the damaged degree of the cartridges and storage case 40 is shown by symbols.

In the drop test (1), since double flute cardboard was used for the outer case 20 only in Comparative Example 1, comparison and contrast using the same criteria are difficult. However, as for displacement of the leader pin of the cartridge, and damage of the cartridges, all the examples reached a level where there was no problem. On the other hand, as for the storage case 40, a bridge portion (refer to the reference numeral 40*a* in FIG. 1) was damaged in Comparative Example 1. Crush of a corner portion of the storage case 40 was less in Comparative Example 1. It is considered that this was greatly related to the fact that the material of the outer case 20 was double flute cardboard, and that, with the use of single flute cardboard, the results would have been different in both the test items of the cartridge and the test items of the storage case 40.

The drop test (2) revealed that Example was superior to Comparative 1 as to damage of the top surface (the upper surface 47*a*) of the storage case 40 and that Example was superior to Comparative 2 as to crush of a corner portion (a corner portion of the flange portion 44). It is considered that this is because the third surface of the backing plate member has a high protection effect. If the corner portion of the flange portion 44 is crushed, an impact is easily applied also to the tape cartridge slot. Therefore, in the test results, although there was incidentally no damage in cartridges of Comparative Example 2, it is easily considered that, with the structure of Comparative Example 2, when the case is dropped during the actual work, the cartridges are easily damaged. Further, in the results of the drop test (1), there was no difference between Comparative Example 2 and Example as to the crush of the corner portion. However, considering the results of the drop test (2), it is easily considered that Comparative Example 2 is susceptible to the crush of the corner portion and the influence on the cartridges accompanied by that also in the drop test (1) under the more severe conditions.

The drop test (1) showed that the corner portions of the storage case of Example were damaged. However, the drop test (1) is a test under the conditions that are improbable in the actual work, and the durability that could withstand this test is not practically required.

In addition, among the symbols used in the table, the symbol representing "no problem" means that there was no deformed portion. "Small damage" means some deformation, though a fragment was not separated. In "intermediate damage" and "great damage", a crack has become relatively large. In the present embodiment, the excellent results were obtained in the drop test (2) that was close to the drop during the actual work.

The table of FIG. 6 also shows the workability during the packaging as the test results. As shown in the figure, since Example 1 was configured so that the one backing plate member 30 was used so as to be able to confirm the front and back, it is found that the workability was superior compared to that of Comparative Example 1 and Comparative Example 2. The reason why the workability of Comparative Example 2 was poor was because it was necessary to confirm the front and back of the backing plate member 50 each time so that the backing plate member 50 was reversed.

Effects Of The Embodiment

According to the present embodiment, the backing plate member 30 has the first surface 31 having the first cutout portions 35*a*, into which the first fitting ribs 49*a* and the second fitting ribs 49*b* that construct the first projecting portions 48*a* are fitted, the second surface 32 having the second cutout portions 35*b*, into which the second fitting ribs 49*b* and the first fitting ribs 49*a* that construct the second projecting portions 48*b* are fitted, and the third surface 33 that foldably connects with both the first surface 31 and the second surface 32. Using the one backing plate member 30 separately from the outer case 20, the storage case 40 is covered by the backing plate member 30, which is then packaged by the outer case 20. Consequently, different from the conventional structure, it is possible to prevent the engagement state between the first cutout portion 35*a* and the first projecting portion 48*a*, and the engagement state between the second cutout portion 35*b* and the second projecting portion 48*b* from becoming shallow.

Therefore, even if the outer case 20 containing the storage case 40 covered by the backing plate member 30 is dropped so that its ridge portion falls off to the floor F first, the storage case 40 hardly moves inside the outer case 20. Further, the third surface 33 of the backing plate member 30 acts as a buffer material. Therefore, in the above test results, if the material of the outer case is the same single flute cardboard is used, it is obvious that the corner portion of the present embodiment has the smallest crush, so that a crack in the storage case 40 can be suppressed, and deformation in the ridge portion of the box portion 43 of the storage case 40 can also be suppressed. From the matters described above, the deformation or damage of the cartridges inside the storage case 40 can also be suppressed. In particular, covering the cartridge tape slots with the backing plate member 30 makes it possible to effectively reduce the impact against the tape slots with relatively low strength. Further, since the cartridges have strength to a certain degree on the side where the tape slots are not provided, there is less fear of deformation or damage even if they are not covered with the backing plate member 30.

As described above, according to the present embodiment, the buffer effect on the storage case 40 can be enhanced. Further, when a plurality of the storage cases 40 are stacked, using the first projecting portions 48*a* and the second projecting portions 48*b* formed on the upper and lower surfaces of the storage case 40 for positioning of the storage cases 40, each projecting portion 48*a*, 49*b* is fitted into each cutout portion 35*a*, 35*b* of the backing plate member 30, whereby the buffer effect is enhanced. Therefore, it is not necessary to provide a projecting portion for the exclusive use thereof.

Further, the first fitting ribs 49*a* and the second fitting ribs 49*b* are disposed point-symmetrically with respect to the center of the upper surface 47*a* of the upper case 41 and the center of the lower surface 47*b* of the lower case 42. Therefore, when the work of continuously packaging a plurality of the storage cases 40 is carried out, the first fitting ribs 49*a* and the second fitting ribs 49*b* are easily engaged with the backing plate member 30 irrespective of the direction of the storage cases 40 as long as the direction of the cartridges faces the backing plate member 30. Therefore the packaging work can be easily carried out. Furthermore, since the backing plate member 30 is formed with the chamfers 37, it becomes easy to cover the storage case 40 having the first fitting ribs and the second fitting ribs that are formed point-symmetrically with the backing plate member 30 in a state in which the front and back of the backing plate member 30 are distinguished, so that the packaging work can be carried out more easily. In addition, since the ridge lines of the corrugated pattern of the core 30*a* and the folding portions 34 are set so as to be perpendicular to each other, it is also possible to prevent the backing plate member 30 from going to waste due to failure in folding during the packaging.

Further, since the relationship between the moving amount of the projecting portion 49*a*, 49*b* of the storage case 40 in the cutout portion 35*a*, 35*b* of the backing plate member 30 and the moving amount of the storage case 40 inside the outer case 20 is restricted, even if the storage case 40 is moved inside the outer case 20 when the outer case 20 is dropped and the like, the movement of the storage case 40 is stopped by the time the storage case 40 is contacted with the inner surface of the outer case 20. Since this enables the impact force applied to the storage case and cartridges from the floor to be reduced, the deformation or damage of the cartridges can effectively be prevented.

Modified Example of Embodiment

In the embodiment, the moving amount of the storage case 40 inside the outer case 20 can be restricted by setting other dimensions.

Figure 5:
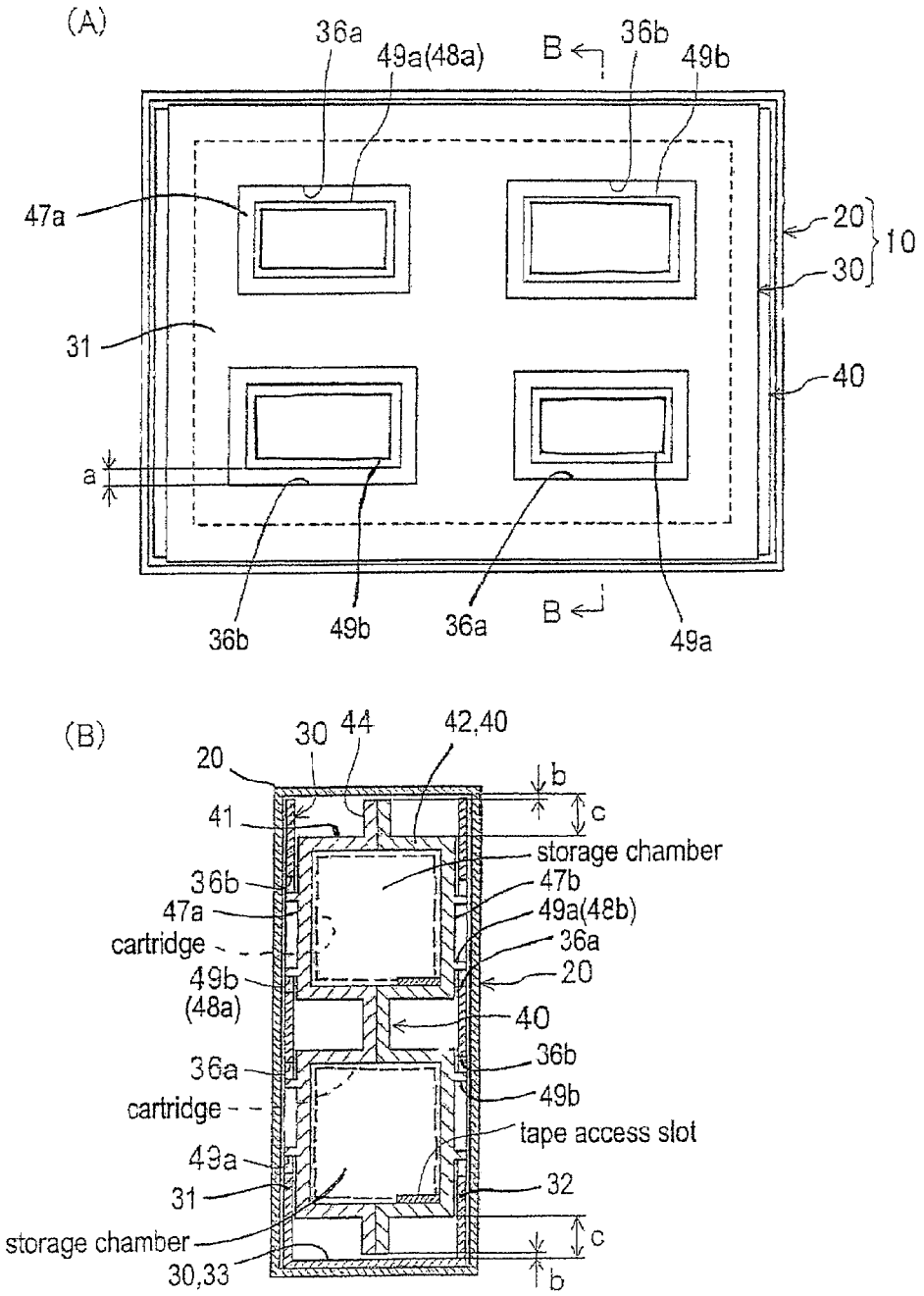
FIG. 5(A) is a plane arrangement view showing a state in which the storage case covered with the backing plate member is put in an outer case.
FIG. 5(B) is a cross sectional view along line B-B of FIG. 5(A)

Specifically, in this modified example, as shown in FIG. 5, the moving amount of the storage case is set based on a gap dimension between the inner surface of the third surface 33 of the backing plate and the side surface of the storage case 40, and a gap dimension between an inner surface of a side plate of the outer case 20 and the side surface of the storage case 40 (namely, the gap dimension between the inner surface of the packaging material 10 and the side surface of the storage case 40, and both of them are represented by "c").

As described above, the moving amount of the storage case 40 can be represented by the gap dimension a between the outer edge of the projecting portion 49*a*, 49*b* of the storage case 40 and the inner edge of the cutout portion 35*a*, 35*b* of the backing plate member 30. In the present modified example, each gap dimension is set so as to satisfy the relational expression:

$$0 \leq a < c \quad (4)$$

With this setting, when the packaged case is dropped on the floor, although the flange portion 44 of the storage case 40 hits the inner surface of the outer case 20, the flange portion 44 is deformed because the storage case 40 is made of a plastic sheet and the flange portion 44 has flexibility. By the time the flange portion 44 is deformed and the side surface 46 of the storage case 40 is contacted with the inner surface of the outer case 20 or the inner surface of the backing plate member 30, the movement of the storage case 40 in the outer case 20 is stopped.

Therefore, also in this modified example, the buffer effect can be enhanced compared with the conventional packaging structure, it becomes possible to enhance the protection performance of the cartridges when the case is dropped.

Another Embodiment

As to the above embodiment, the following structure may be applied.

Figure 7:
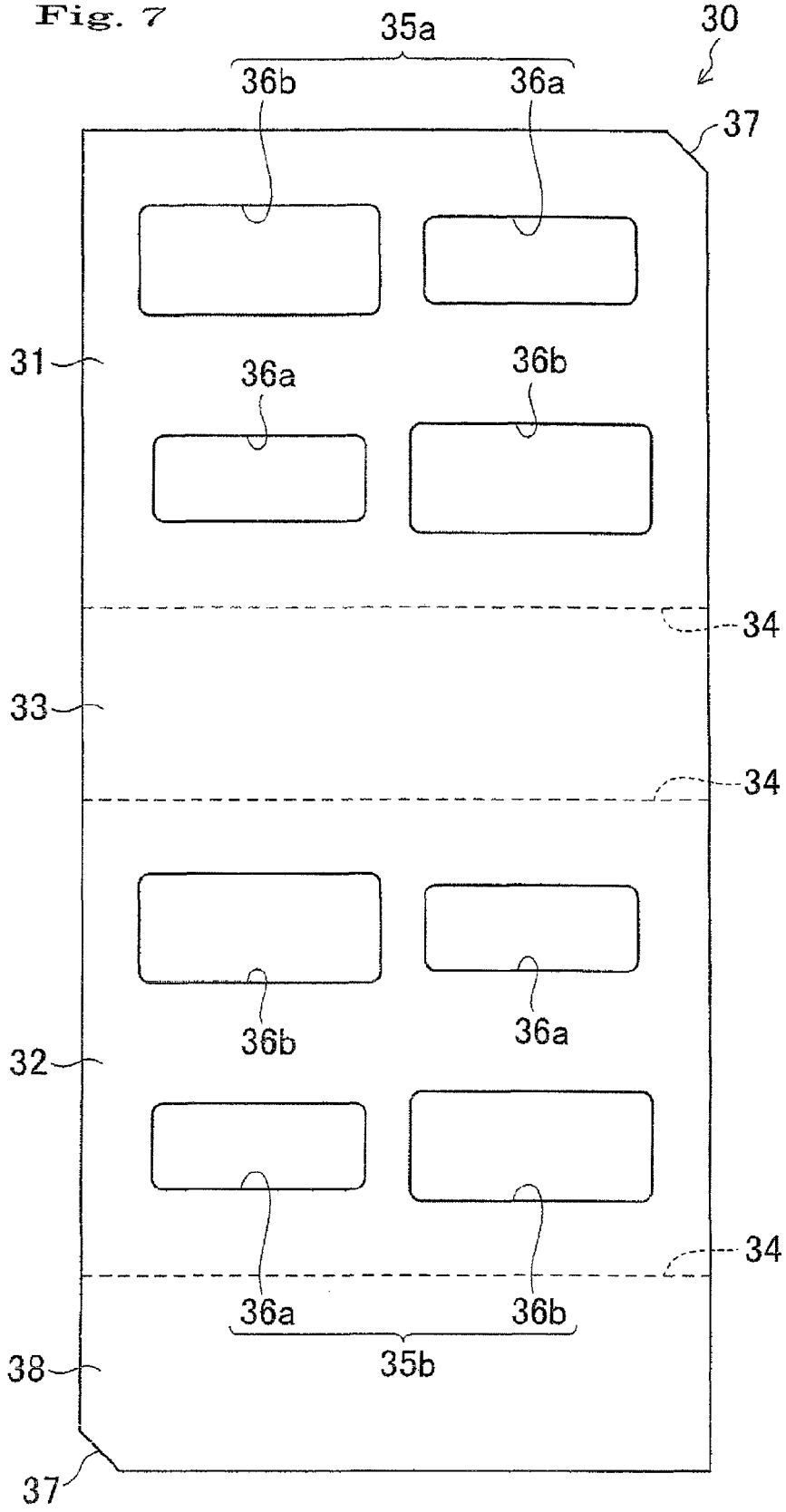
FIG. 7 is a plan view of a backing plate member of a modified example.

For example, in the above embodiment, the backing plate member 30 is formed of the one sheet-shaped member consisting of the three surfaces of the first surface 31, the second surface 32 and the third surface 33. However, the backing plate member may be formed of one sheet-shaped member consisting of four surfaces of a first surface, a second surface, a third surface, and a fourth surface as shown in FIG. 7. In this case also, the backing plate member 30 is constructed so as to be able to be folded between the respective surfaces 31, 32, 33, 38.

Figure 8:
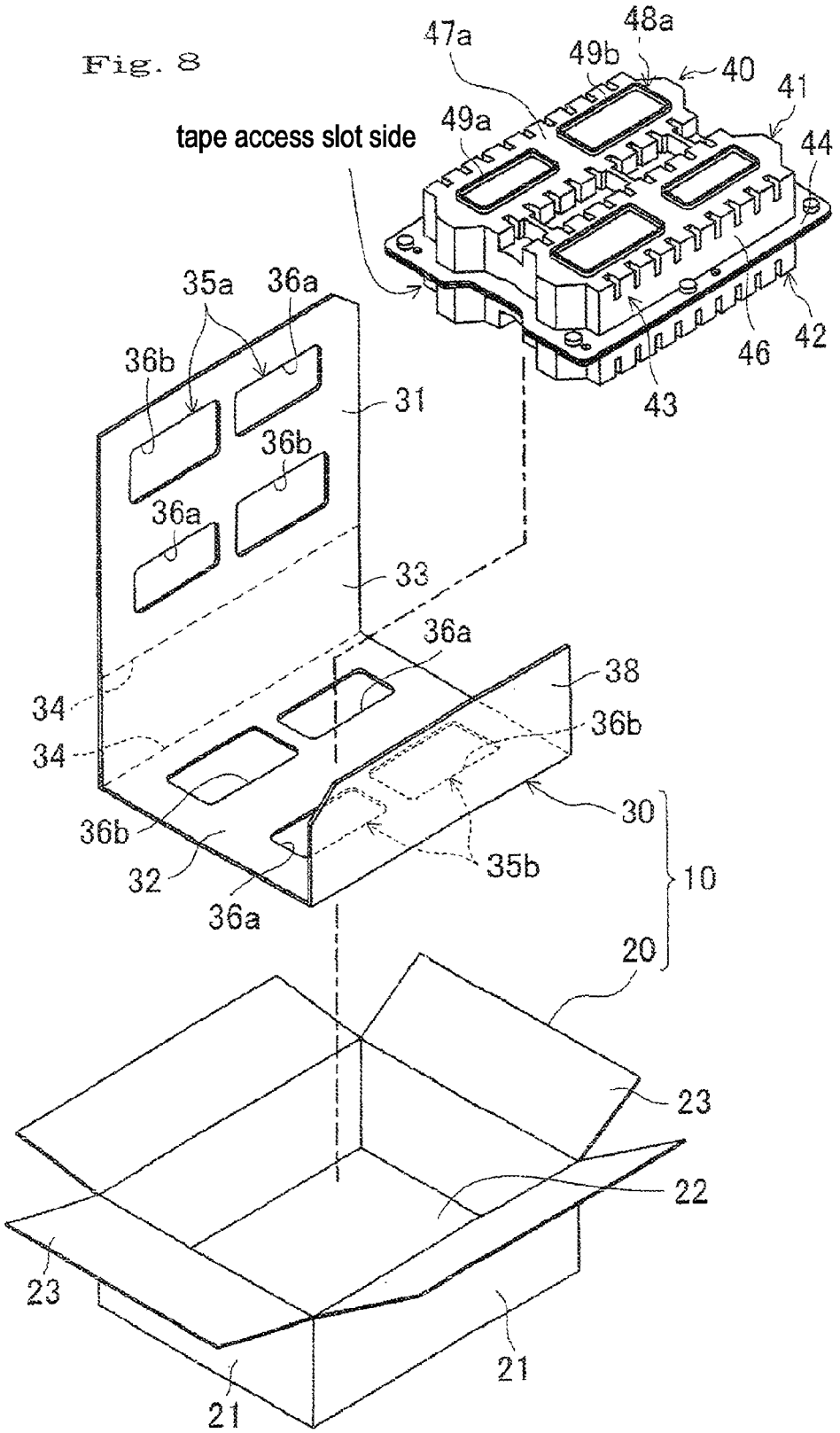
FIG. 8 is an exploded perspective view of the cartridge packaging structure, using the backing plate member of the modified example.
Figure 9:
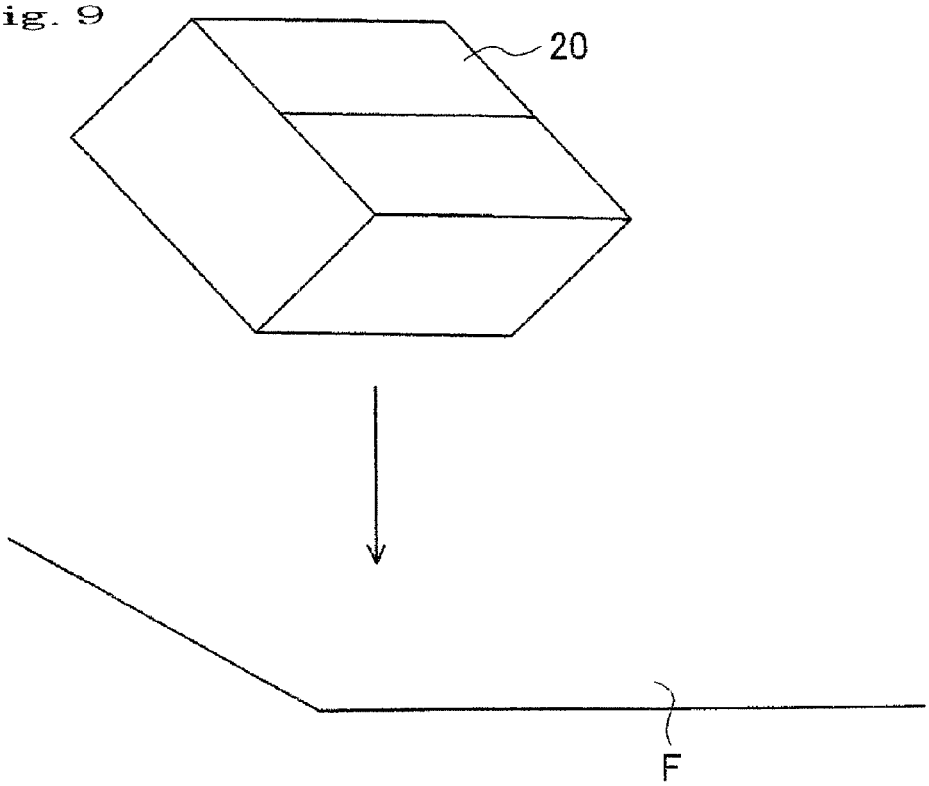
FIG. 9 is a perspective view showing a state in which the outer case is falling to the floor.
Figure 10:
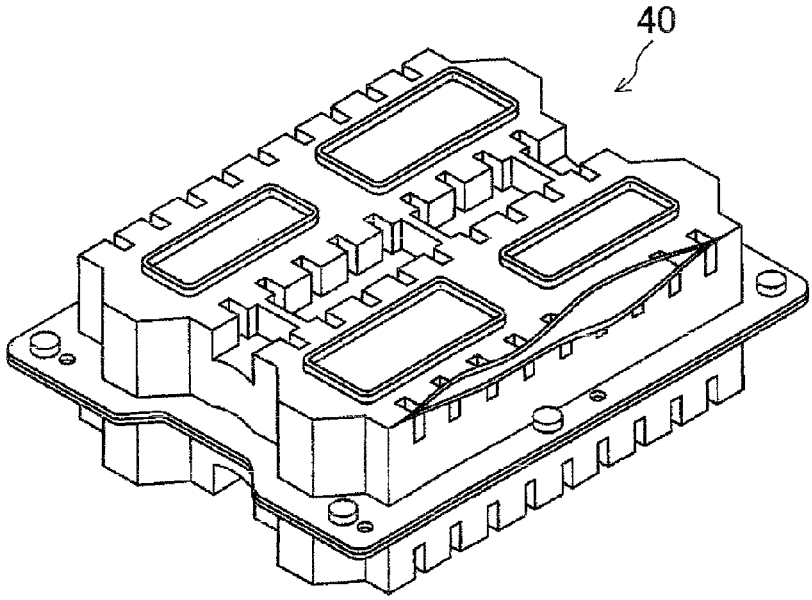
FIG. 10 is a perspective view showing a damaged storage case.

If this backing plate member 30 is used, the storing work is carried out as shown in FIG. 8. In this case also, the backing plate member 30 in a folded state is illustrated for simply showing the shape of the backing plate member 30. The following work is carried out. The backing plate member 30 is placed on the outer case 20 so that the second surface covers an opening of the outer case 20, and the storage case 40 is pushed into the outer case 20. Further, after that, the first surface 31 of the backing plate member 30 is folded to close flaps 23 of the outer case 20. This makes it possible to carry out the work easily.

With this arrangement, since the storage case 40 is covered by the four surfaces of the backing plate member 30, it becomes possible to enhance the buffer effect more. The other constructions and effects are the same as those of the above embodiment.

Further, although not shown, the storage case 40 is not necessarily of the type in which 10 cartridges each are disposed in two rows. The numbers of rows and cartridges to be stored may be changed as necessary.

Furthermore, the shape of the upper case 41 and the lower case 42, the shape of the projecting portions and the like may be changed as necessary as long as they are used in combination with the backing plate member 30 to achieve the same effects as those of the above embodiment.

The above embodiments are examples that are essentially preferable, and it should not be construed that they limit the present invention, an applied product thereof or the scope of its usage.

Industrial Applicability

As described above, the present invention is useful for the packaging material of the type in which the storage case 40 storing data recording cartridges is put in the outer case for protection, and the packaging structure in which the cartridge storage case 40 is packaged using this packaging material.

Description of Reference Numerals

10 cartridge packaging material
20 outer case
30 backing plate member
31 first surface
32 second surface
33 third surface
35*a* first cutout portion
35*b* second cutout portion
37 chamfer (portion for distinguishing the front from the back)
40 storage case

41 upper case
42 lower case
44 flange portion
47*a* upper surface
47*b* lower surface
48*a* first projecting portion
48*b* second projecting portion
49*a* first fitting rib
49*b* second fitting rib

What is claimed is:

1. A cartridge packaging material in combination with a storage case that stores data recording cartridges, the storage case having first projecting portions that consist of first and second fitting ribs, each projecting from an upper surface of the storage case, and second projecting portions that consist of first and second fitting ribs, each projecting from a lower surface of the storage case, the cartridge packaging material comprising:

a backing plate member formed by bending a sheet-shaped member so that it covers the upper surface, the lower surface and at least one side surface of the storage case, the backing plate member having first cutout portions, each for receiving the first projecting portion, and second cutout portions, each for receiving the second projecting portion; and an outer case for storing the storage case in a fitted state in which the backing plate member is along the first surface, the second surface and the at least one side surface of the storage case, wherein the two annular first fitting ribs and the two annular second fitting ribs are respectively disposed point symmetrically on diagonal lines passing the center of the upper surface of the storage case, each second fitting rib being larger than each first fitting rib, the second fitting rib being engageable with the first fitting rib, wherein the annular second fitting ribs and the annular first fitting ribs of the second projecting portions are disposed at positions of the lower surface of the storage case where the first fitting ribs and the second fitting ribs of the first projecting portions are respectively engageable, wherein when the plurality of storage cases are stacked, the first projecting portions and the second projecting portions are respectively engaged, wherein the backing plate member is formed of a sheet-shaped member consisting of at least three surfaces, which are a first surface which is along the upper surface of the storage case, and formed with the first cutout portions, a second surface which is along a bottom surface of the storage case, and formed with the second cutout portions, and a third surface foldably connecting with both the first surface and the second surface, and is along the at least one side surface of the storage case, wherein the first cutout portions of the first surface include first openings and second openings, the first openings being formed so that their positions and shape correspond to those of the first fitting ribs formed on the upper surface of the storage case, the second openings being formed so that their positions and the shape correspond to those of the second fitting ribs formed thereon, and the first projecting portions are constructed by the first fitting ribs and the second fitting ribs, wherein the second cutout portions of the second surface include first openings and second openings, the first openings being formed so that their positions and shape correspond to those of the first fitting ribs formed on the lower surface of the storage case, the second openings being formed so that their positions and the shape correspond to those of the second fitting ribs formed thereon, and the second projecting portions are constructed by the first fitting ribs and the second fitting ribs, wherein each second opening has a larger opening area than each first opening, and the first opening and the second opening are point-symmetrically disposed, the sheet-shaped member forming the backing plate member is corrugated cardboard, and a folding portion provided to fold the backing plate member into a plurality of surfaces is formed along a line extending in a direction perpendicular to corrugated ridge lines forming a core of the corrugated cardboard.

2. The cartridge packaging material according to claim 1, wherein the backing plate member is formed of a sheet-shaped member consisting of three surfaces, which are a first surface which is along the upper surface of the storage case, and formed with the first cutout portions, a second surface which is along a bottom surface of the storage case, and formed with the second cutout portions, and a third surface foldably connecting with both the first surface and the second surface, and is along the at least one side surface of the storage case.

3. The cartridge packaging material according to claim 1 or 2, wherein the cutout portion is a hole formed in the backing plate member.

4. The cartridge packaging structure according to claim 1, wherein the first and second fitting ribs have a rectangular annular shape.

5. A cartridge packaging structure comprising:

a storage case that stores data recording cartridges, the storage case having first projecting portions that consist of first and second fitting ribs, each projecting from an upper surface of the storage case, and second projecting portions that consist of first and second fitting ribs, each projecting from a lower surface of the storage case; and a packaging material for storing the storage case, wherein the packaging material comprises:

a backing plate member formed by bending a sheet-shaped cardboard so that it covers the upper surface, the lower surface and at least one side surface of the storage case, the backing plate member having first cutout portions, each for receiving the first projecting portion, and second cutout portions, each for receiving the second projecting portion; and an outer case for storing the storage case in a fitted state in which the backing plate member is along the first surface, the second surface and the at least one side surface of the storage case, wherein the backing plate member is formed of a sheet-shaped cardboard consisting of three surfaces, which are a first surface which is along the upper surface of the storage case, and formed with the first cutout portions, a second surface which is along a bottom surface of the storage case, and formed with the second cutout portions, and a third surface foldably connecting with both the first surface and the second surface, and is along the at least one side surface of the storage case, wherein the two annular first fitting ribs and the two annular second fitting ribs are respectively disposed point symmetrically on diagonal lines passing the center of the upper surface of the storage case, each second fitting rib being larger than each first fitting rib, the second fitting rib being engageable with the first fitting rib, wherein the annular second fitting ribs and the annular first fitting ribs of the second projecting portions are disposed at positions of the lower surface of the storage case where the first fitting ribs and the second fitting ribs of the first projecting portions are respectively engageable, and wherein when the plurality of storage cases are stacked, the first projecting portions and the second projecting portions are respectively engaged.

6. The cartridge packaging structure according to claim 5, wherein a storage chamber for storing a plurality of cartridges is formed as a compartment in the storage case by a combination of an upper case and a lower case thereof that are divided up and down, the first projecting portions in even number are formed on the upper case, and include the same numbers of annular first fitting ribs and annular second fitting ribs that are larger than the annular first fitting ribs, each annular first fitting rib and each annular second fitting rib projecting from the upper surface of the upper case, the second projecting portions having the same number as the first projecting portions are formed on the lower case, and include the same numbers of annular first fitting ribs and annular second fitting ribs that are larger than the annular first fitting ribs, each annular first fitting rib and each annular second fitting rib projecting from the lower surface of the lower case, the first fitting rib of the first projecting portion and the first fitting rib of the second projecting portion have the same shape, the second fitting rib of the first projecting portion and the second fitting rib of the second projecting portion have the same shape, and the first fitting rib of the first projecting portion and the second fitting rib of the second projecting portion are engaged with each other, and the second fitting rib of the first projecting portion and the first fitting rib of the second projecting portion are fitted to each other.

7. The cartridge packaging structure according to claim 5 or 6, wherein chamfers are formed at two corner portions located at diagonal positions of the backing plate member as front and back distinguishing portions for distinguishing the front from the back.

8. The packaging structure according to claim 5 or 6, wherein cartridges are arranged so that an access slot to a recording medium stored inside each cartridge faces the direction of the backing plate member covering the side surface of the storage case.

9. The cartridge packaging structure according to claim 5 or 6, wherein the movable amount of the storage case inside the outer case is restricted based on the movable amount of the projecting portion of the storage case in the cutout portion of the backing plate member.

10. The cartridge packaging structure according to claim 9, wherein the storage case has flange portions, each extending outward from each side surface thereof, and a gap dimension a between an inner edge of the cutout portion of the backing plate member and an outer edge of the projecting portion of the storage case, and a gap dimension b between the flange portion and an inner surface of the packaging material are set so as to satisfy the relational expression:

$0 \leq a < b$, and the moving amount of the storage case inside the outer case is smaller than the moving amount until an outer peripheral end face of the flange portion is contacted with an inner surface of the outer case.

11. The cartridge packaging structure according to claim 9, wherein the storage case has flange portions, each extending outward from each side surface thereof, and a gap dimension a between an inner edge of the cutout portion of the backing plate member and an outer edge of the projecting portion of the storage case, and a gap dimension b between the flange portion and an inner surface of the packaging material are set so as to satisfy the relational expression:

$a=b$, and the moving amount of the storage case inside the outer case is equal to the moving amount until an outer peripheral end face of the flange portion is contacted with an inner surface of the outer case.

12. The cartridge packaging structure according to claim 9, wherein the storage case has flexible flange portions, each extending outward from each side surface thereof, and a gap dimension a between an inner edge of the cutout portion of the backing plate member and an outer edge of the projecting portion of the storage case, and a gap dimension c between the side surface of the storage case and an inner surface of the packaging material are set so as to satisfy the relational expression:

$0 \leq a < c$, and the moving amount of the storage case inside the outer case is smaller than the moving amount until the flange is deformed, and the side surface of the storage case is contacted with an inner surface of the outer case.

13. The cartridge packaging structure according to claim 5, wherein the first and second fitting ribs have a rectangular annular shape.

* * * * *